US005549413A

United States Patent [19]

Bolden

[11] Patent Number: 5,549,413

[45] Date of Patent: Aug. 27, 1996

[54] MULTI-USE CONCRETE FINISHING APPARATUS

[76] Inventor: Gary A. Bolden, 4530 Coventry La. NE., Cedar Rapids, Iowa 52402

[21] Appl. No.: 368,042

[22] Filed: Jan. 3, 1995

[51] Int. Cl.[6] ..... E01C 19/43

[52] U.S. Cl. ..... 404/93; 404/97; 404/118; 15/159.1

[58] Field of Search ..... 404/89, 93, 96, 404/97, 118; 15/159.1, 207.2, DIG. 6, 235.4, 235.6

[56] References Cited

U.S. PATENT DOCUMENTS

| | | | |
|---|---|---|---|
| 774,005 | 11/1904 | Thies . | |
| 1,291,544 | 1/1919 | Keenan . | |
| 3,595,143 | 7/1971 | Polselli . | |
| 3,596,578 | 8/1971 | Jones . | |
| 3,703,857 | 11/1972 | MacKinnon . | |
| 3,846,036 | 11/1974 | Baker . | |
| 3,906,580 | 9/1975 | Smith et al. | 15/159.1 X |
| 3,936,209 | 2/1976 | Krage . | |
| 3,936,210 | 2/1976 | Oehlerking . | |
| 3,989,401 | 11/1976 | Moench . | |
| 4,032,249 | 6/1977 | DeVitis . | |
| 4,070,128 | 1/1978 | Garrison . | |
| 4,743,140 | 5/1988 | Maletic . | |
| 4,744,694 | 5/1988 | Leone . | |
| 4,759,658 | 7/1988 | Manor . | |
| 4,784,517 | 11/1988 | Bergqvist et al. . | |
| 4,789,265 | 12/1988 | Wilson et al. | 404/96 X |
| 4,861,188 | 8/1989 | Rouillard . | |
| 4,882,802 | 11/1989 | LeVere, Jr. . | |
| 4,917,533 | 4/1990 | Wilson | 404/96 X |
| 4,921,372 | 5/1990 | Hybertson . | |
| 5,452,490 | 9/1995 | Brundula et al. | 15/DIG. 6 X |

*Primary Examiner*—Michael Powell Buiz
*Assistant Examiner*—James A. Lisehura
*Attorney, Agent, or Firm*—Simmons, Perrine, Albright & Ellwood PLC

[57] ABSTRACT

An improved flatwork concrete finishing apparatus includes a side-by-side pair of parallel spaced elongate brush assemblies, each brush assembly having an elongate head with a pair of upper corners or stops, a downwardly directed throat with opposing inwardly directed grooves, and a plurality of replaceable elongate blocks, each having at least one row of color-coded bristles with a stiffness different than the bristles of at least one of the other blocks. Each of the blocks have outwardly directed ridges adapted to be slidably received by the grooves. A plurality of corresponding pairs of brackets attached to each of the pair of brush assemblies are interconnected by a plurality of spacers pivotally connected thereto. Interaction between the spacers and one of the stops of each of the brush assemblies establishes the angular orientation of the brush assemblies as the apparatus is displaced across the flatwork in one direction, and between the spacers and the other stops of the brush assemblies establishes the equal but opposite angular orientation of the brush assemblies as the apparatus is displaced across the flatwork in the opposite direction. The pair of brush assemblies are adapted to be disassembled and interchangeably attached to a screw-on type handle or a push-pin type handle for small jobs.

15 Claims, 2 Drawing Sheets

Fig.1.
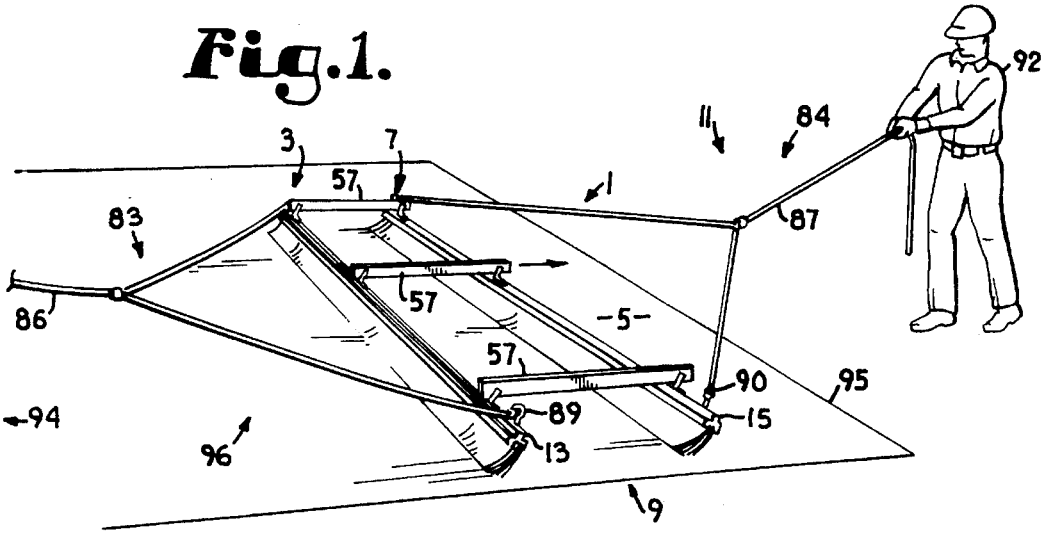
Fig.2.
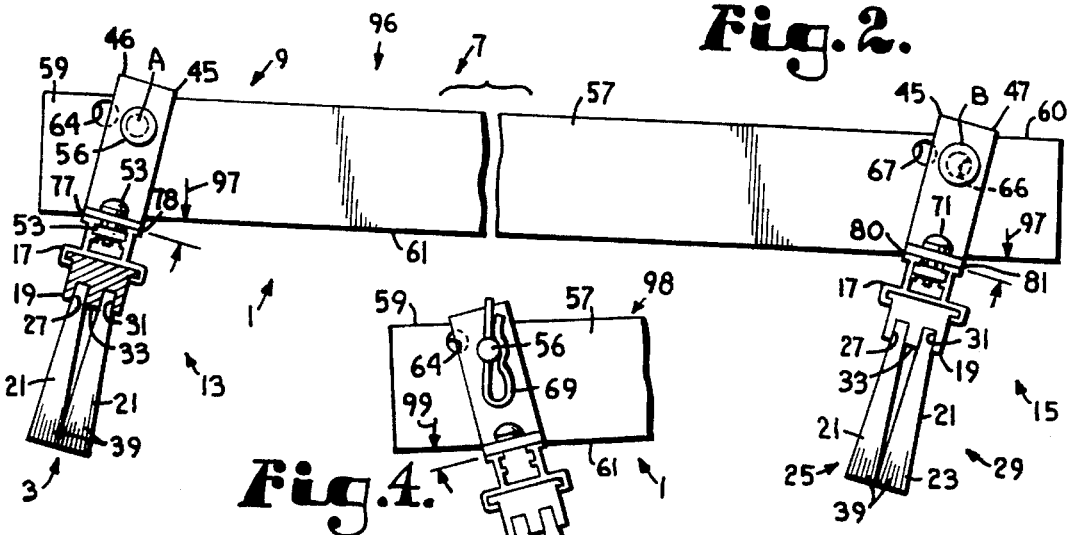
Fig.4.
Fig.7.
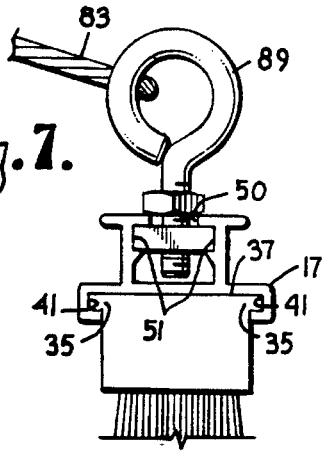
Fig.6.
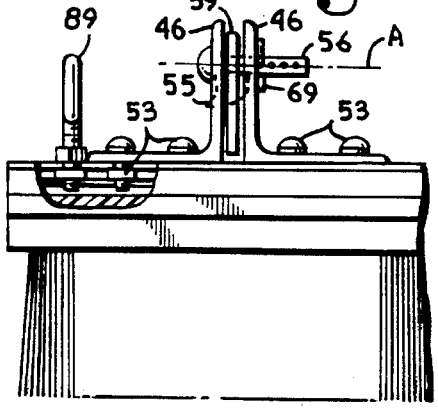

Fig. 3.
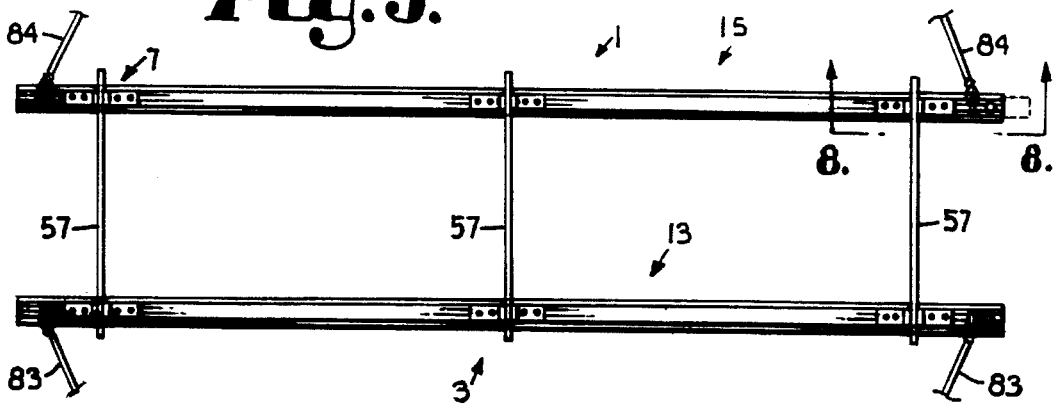
Fig. 8.
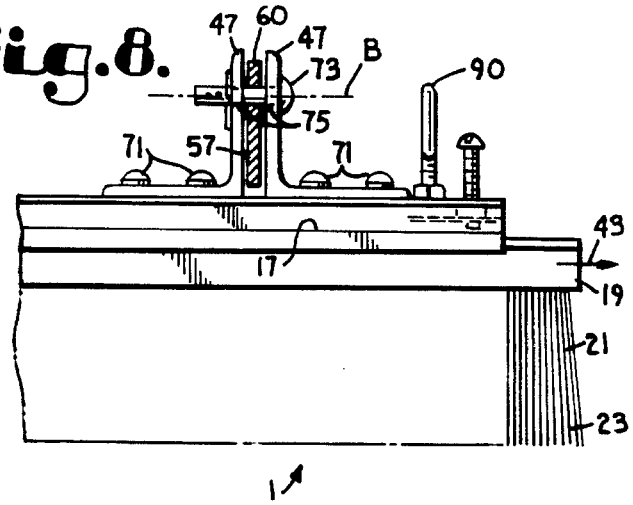
Fig. 5.
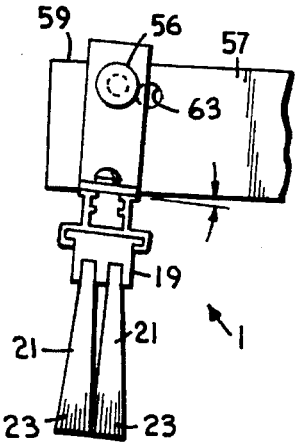
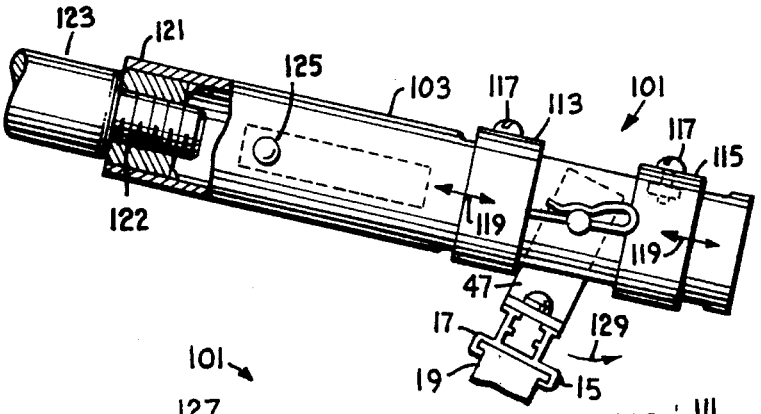
Fig. 9.
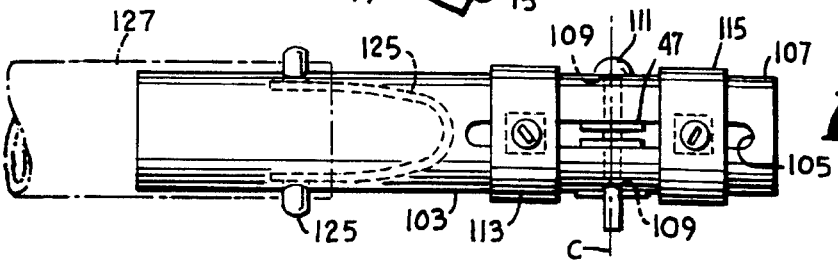
Fig. 10.

MULTI-USE CONCRETE FINISHING APPARATUS

BACKGROUND OF THE INVENTION

Concrete is used for a multitude of different applications including the formation of substantially horizontal, hard surfaces commonly referred to as flatwork. The concrete is initially formed into a pourable and workable substance comprising cement, rock aggregate, water, and other additives. The concrete is then poured into forms or other containing structures where it hardens, or "cures". As the concrete begins to harden, it is generally worked with trowels, troweling machines or various other instruments in order to obtain a relative uniform, non-wavy, durable surface. As a result of such activity, the surface of the concrete may obtain a relatively smooth texture, which can be dangerous for some applications—such as sidewalks, driveways, highways, and the like—particularly when the surface is damp, frosty or icy.

To minimize such dangers, the concrete is given a roughened surface as it is hardening, sometimes referred to as a "broom" finish. Such roughening is sometimes accomplished by pushing or dragging the bristles of a broom across the surface of the hardening concrete in a direction generally perpendicular to the anticipated flow of traffic on that surface. As a result, the surface is scored with randomly spaced bristle marks, which marks harden in the surface of the concrete thereby providing a surface which minimizes tendencies for slipping.

The degree of scoring for a particular surface generally depends on the anticipated use of that surface. Sidewalks and patios, which are primarily exposed only to foot traffic, for example, need only light or fine scoring to provide a slip-resistant surface. On the other hand, highways, streets, parking lots and bridges, which are primarily subjected to vehicular traffic as opposed to foot traffic, generally require much coarser scoring in order to provide a slip-resistant surface for the vehicles traveling therealong.

It is well known to use a garage-type push broom or brush to roughen or score the surface of concrete. Such brushes typically have a width of two feet, or less. Some prior art brushes specially manufactured for finishing concrete have widths of 24, 36 or 48 inches. The bristles thereof, which are generally constructed of polypropylene, horsehair, or nylon, are generally staple set or otherwise formed into channel style strips in a wooden head such that the bristles extend generally perpendicularly downwardly from the wooden head. Another problem with the wooden heads of prior art brushes is the relatively rapid deterioration of the wooden heads due to exposure thereof with the corrosive constituents of the concrete material.

To maneuver the brush over the surface of the wet concrete, the brush head is generally attached to the end of a long handle having a sufficient number of sections attached end-to-end such that a user can reach either entirely across the flatwork or at least half-way across, depending on the width of the flatwork. The user then places the bristles of the brush against the flatwork at the side of the flatwork nearest the user and uses the handle to push the brush in a straight line to the side of the flatwork opposite from the user (or slightly beyond midway as the case may be).

Then, using the handle as a lever, the user lifts the brush clear of the flatwork and maneuvers the brush to a new position on the flatwork immediately adjacent to that from which the brush was lifted. In fact, the brush is spaced such that the return path to be swept by the brush slightly overlaps the previous path in order to avoid leaving an unroughened strip of concrete between the adjacent sweeps. The handle is then used to pull the brush back to the side of the flatwork nearest the user. The described process is repeated until either the entire surface, or half of the surface nearest the user, is "broomed". If only half of the surface is reachable by the long handle, the user then proceeds to the opposite side of the flatwork to broom the remaining half of the flatwork.

Depending on the length of the handle, a considerable torque or moment must sometimes be applied by the user to lift the brush from the concrete, particularly since the brush becomes gradually heavier due to the concrete that accumulates in and on the brush during use. Additional responsibility is placed on the user to avoid allowing the brush to drop back against or bump the surface of the concrete as the bristles are directed substantially perpendicularly to the surface and can easily gouge concrete material from the surface.

Another complication arising from the use of a prior art concrete finishing brush is the long handle, while limits the user's ability to use it in congested or crowded quarters, such as inside a building or near surrounding structures, due to interference with the necessary path of the long handle during the pulling and pushing procedure inherent in concrete finishing with a brush having a long handle.

The channel strip-type brushes used in prior art devices have essentially no gaps between the bristles, just one straight row of continuous bristle fill. As a result, such channel strip-type brushes tend to pull or squeegee the "cream" from the surface of the flatwork concrete. In an attempt to avoid this undesirable effect, some prior art concrete finishing brushes have been constructed with staple set-type bristles which pull or squeegee less "cream" than channel strip-type brushes due to a multiple-row configuration of the bristles, wherein each row has a plurality of equally spaced gaps between clusters of bristles, with the gaps of a consecutive row(s) staggered to fill the gaps of the adjacent row(s).

Factors affecting the roughness of the broomed finish include, among other things, the stiffness of the bristles, the angular orientation of the bristles at their point of contact with the flatwork, the softness or "green"-ness of the concrete at the time the roughening finish is applied, etc. As the bristles of most of the prior art brushes are generally approximately perpendicular to the surface of the flatwork, the brush must not be applied too quickly after the "pour", such as when the concrete has just been "floated" and is very soft and creamy. Otherwise, the tips of the bristles will gouge too deeply into the concrete surface or will scrape off the "creamy" surface and expose the aggregate, or both. As a result, brooming of the flatwork concrete with prior art concrete finishing brushes is generally delayed until the concrete begins to "set" whereby it can more readily endure the abusiveness to the flatwork arising from contact with brushes having bristles oriented substantially perpendicularly to the flatwork.

Many times during such delay of using a prior art finishing device, a user may get distracted and not realize that the concrete has hardened more than intended; in other words, the user has waited too long and the concrete has "set" or hardened to the point that the weight of the brush is more easily supported by the green flatwork. Even though some roughening may still be possible, the extent thereof may be substantially less than that desired in order to obtain a slip-resistant surface. Under those circumstance, the user sometimes attempts to enhance the effect of the brooming procedure by tying weights to the brush. Such remedial measure may not provide a practical solution, however, particularly if the user must lift that extra weight at the end of a long handle for the return sweep. In addition, the added weight may cause the surface to become more uneven as some portions of the surface may have cured slightly earlier than other portions of that surface.

What is needed is a concrete finishing tool that substantially uses the sides of the bristles instead of the ends of the bristles for "brooming" flatwork concrete, that does not require the use of a long handle, that can be used to "broom" the entire width of flatwork even though the flatwork may have virtually unlimited width, that can be used to easily sweep strips having widths substantially greater than four feet, that can be used to uniformly and reliably "broom" a flatwork surface shortly after the concrete is poured thereby avoiding the risk of delaying too long before brooming, that avoids the costs of personnel who might not otherwise be overly productive while waiting for the flatwork to partially set as required by prior art concrete finishing devices, that can be used in congested spaces, and that can be quickly disassembled for use with either a push-pin handle or a screw-on handle in a conventional manner while preserving the ability to broom concrete substantially with the sides of the bristles as opposed to the ends of the bristles.

SUMMARY OF THE INVENTION

A multi-use apparatus is provided for finishing flatwork concrete having a pair of brush assemblies, each with a plurality of bristle blocks with at least one row of bristles, each block having color-coded bristles with a particular stiffness of a plurality of available stiffnesses, and each block having opposing outwardly directed first ridges; each brush having an elongate head with a downwardly directed elongate throat with a pair of opposing inwardly directed grooves adapted to slidably receive the pair of ridges of a respective one of the blocks lengthwise therethrough; each having a plurality of pairs of brackets pivotally attaching the head thereof to an end of a plurality of parallel spaced spacers interconnecting the two brushes such that the two brushes are spaced in side-by-side relation; a plurality of pivot centers adapted to operably determine a selected angular orientation of the two brush assemblies relative to the flatwork concrete as the apparatus is swept in one direction and to automatically re-orient the two brush assemblies in a substantially similar, but opposite, angular orientation relative to the flatwork concrete as the apparatus is swept in the opposite direction; and harness for displacing or sweeping the apparatus first in one direction followed by sweeping the device in the opposite direction.

The device is adapted to be disassembled such that one of the brush assemblies can be used with a multi-purpose connector for interchangeably connecting a conventional handle, either of the push-pin type or of the screw-on type, as available, to a centrally located pair of the brackets whereby one of the brush assemblies can be used for brooming areas which are too small for using the complete apparatus, while preserving the ability to automatically and angularly orient the brush relative to the flatwork concrete such that substantially the bristle sides, as opposed to the bristle ends, are used for brooming the flatwork.

OBJECTS AND ADVANTAGES OF THE INVENTION

Therefore, the principal objects and advantages of the present invention include: providing a concrete finishing apparatus that can be used to apply a broom finish across the entire width of flatwork having virtually unlimited width; providing such a concrete finishing apparatus that can be used in crowded or congested areas; providing such a concrete finishing apparatus that can be used to apply a broom finish shortly after the flatwork is floated without having to wait until the concrete begins to set; providing such a concrete finishing apparatus that broom finishes flatwork concrete more with the sides of bristles rather than the ends of bristles; providing such a concrete finishing apparatus that can be used without a long handle; providing such a concrete finishing apparatus that can be used to sweep widths of greater than four feet; providing such a concrete finishing apparatus that can be disassembled and used equally well with a push-pin type handle or a screw-on type handle for areas too small to be finished with the completely assembled apparatus; and generally providing such a concrete finishing apparatus that is simple and easy to use and maintain, easy to operate efficiently and reliably, and which generally performs the requirements of its intended purposes.

Various objects, features and advantages of this invention will become apparent from the following description taken in conjunction with the accompanying drawings, which constitute a part of this specification and which set forth, by way of illustration, certain exemplary embodiments of this invention.

BRIEF DESCRIPTION OF THE DRAWINGS

FIG. 1 is a perspective view of a multi-purpose concrete finishing apparatus, according to the present invention.

FIG. 2 is an enlarged and fragmentary, side elevational view of the multi-purpose concrete finishing apparatus, showing a selected angular orientation automatically assumed by brushes thereof as the apparatus is being pulled to the right.

FIG. 3 is a fragmentary, plan view of the multi-purpose concrete finishing apparatus.

FIG. 4 is an enlarged and fragmentary, side elevational view of the multi-purpose concrete finishing apparatus, similar to FIG. 2 but showing the angular orientation automatically assumed by the brushes as the apparatus is being pulled to the left.

FIG. 5 is an enlarged and fragmentary, side elevational view of the multi-purpose concrete finishing apparatus, similar to FIG. 4 but showing a different selected angular orientation assumed by the brushes as the apparatus is being pulled to the right.

FIG. 6 is a further enlarged and fragmentary, side elevational view of the multi-purpose concrete finishing apparatus, showing a portion cut away to reveal details thereof.

FIG. 7 is a yet further enlarged and fragmentary, end elevational view of the multi-purpose concrete finishing apparatus, showing details of a block thereof.

FIG. 8 is a further enlarged and fragmentary, side elevational view of the multi-purpose concrete finishing apparatus, taken along line 8—8 of FIG. 3, showing the block being removed.

FIG. 9 is an enlarged side elevational view of a connector of the multi-purpose concrete finishing apparatus, showing a portion cut away to review details of the connector being used with a screw-on type handle.

FIG. 10 is an enlarged view of the connector of the multi-purpose concrete finishing apparatus, taken perpendicularly to that shown in FIG. 9 but showing the connector being used with a push-pin type handle, according to the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The concrete finishing brush apparatus 1, as shown in FIGS. 1 through 10, comprises texturing means 3 for texturing or roughening the surface of freshly poured concrete flatwork 5, mounting means 7 for mounting the texturing means 3, control means 9 for controlling the texturing means 3, and towing or displacement means 11 for towing or displacing the texturing means 3 relative to the flatwork 5.

The texturing means 3 generally includes a pair of brush assemblies 13 and 15, each with a head 17, a bristle block 19 and bristles 21. Preferably, the heads 17 are constructed of lightweight material, such as extruded aluminum or other suitable material, which is acceptably durable when exposed to the corrosive and degrading constituents contained in concrete material. The bristles 21 are constructed of fill 23 with an acceptable bend recovery rate, such as 6/12 nylon or other suitable material. For some applications, the fill 23 is preferably "soft", such as 0.010" diameter nylon. For other applications, the fill 23 is preferably "stiff" such as 0.022" diameter nylon. For yet other applications, the fill 23 has a "medium" stiffness, such as 0.016" diameter nylon. For ease of identification, each stiffness is preferably color-coded, such as black for "soft", orange for "medium", and green for "stiff".

Each of the blocks 19, which is constructed of polyvinylchloride ("PVC") or other suitable material, has a first set 25 of uniformly and linearly spaced partial bores 27 which are spaced parallel to a second set 29 of uniformly and linearly spaced partial bores 31 in a bottom surface 33 of each of the blocks 19, as shown in FIG. 2. The set 25 is axially offset from the set 29 such that the partial bores 27 are staggered relative to the partial bores 31. Each of the blocks 19 has a pair of opposing, outwardly directed ridges 35 along an upper surface 37 thereof, as shown in FIG. 7.

The diameter of each of the bores 27 and 31 and the spacing therebetween is dependent upon the diameter, quantity and length of the fill 23 being used for each cluster 39 of the bristles 21. For example, the bores 27 and 31 may each have a diameter of approximately 13/64 inch, a center-to-center spacing between adjacent ones of the bores 27 and between adjacent ones of the bores 31 of approximately 5/16 inch, and a center-to-center spacing between the set 25 and the set 29 of approximately 7/16 inch. Each of the clusters 39 is secured to its respective bore 27 or 31 by stapling, or other suitable means. In the preceding example, the bristles 21 may extend approximately 2¼ inches generally perpendicularly outwardly from the respective blocks 19.

The head 17 has a pair of opposing, inwardly directed grooves 41 which are adapted to cooperatively receive the ridges 35 slidingly and longitudinally therethrough, as indicated by the arrow designated by the numeral 43 in FIG. 8. The ridges 35 are generally frictionally retained with the grooves 41. The length of the head 17 is generally co-extensive with the length of the block 19 contained therein.

It is to be understood that, for some applications, several of the blocks 19 may be contained within the head 17, with the blocks 19 having a combined length co-extensive with the length of the head 17. For example, shorter sections of the blocks 19 normally have lower friction relative to the head 17 and can be more easily removed and reinserted into the grooves 41 than can a single one of the bases 19 having a length co-extensive with the head 17.

The mounting means 7 generally include a plurality of opposing pairs of brackets 45, such as the opposing pairs of brackets 45 designated by the numerals 46 and 47 in FIG. 2. Each of the heads 17 generally has an upwardly directed slot 50 with a pair of opposing and inwardly directed grooves 51, as shown in FIG. 7. Each pair of the opposing pairs of brackets 46 are connected to the respective head 17 by bolts and nuts 53 slid lengthwise along the slot 50 as desired and secured in place.

Each of the pairs of brackets 46 has as aligned pair of throughbores 55 for slidably receiving a pivot pin 56 therethrough, as shown in FIG. 6. The mounting means 7 also include a plurality of spacers 57, each having a first end 59 a second end 60, and a lower edge 61. Each of the spacers 57 generally has one or more throughbores in each of the ends 59 and 60, such as the throughbores 63 and 64 in the end 59 for slidably receiving the pivot pin 56 therethrough, as shown in FIGS. 4 through 6, and the throughbores 66 and 67 in the end 60, as shown in FIG. 2. A keeper 69 retains the pivot pin 56 such that the spacers 57 pivot about axis "A" relative to the brackets 46, as shown in FIGS. 2 and 6.

Similarly, the brush assembly 15 is attached to the opposing pairs of brackets 47 by nuts and bolts 71. Again, each of the opposing pairs of brackets 47 is pivotally connected by a pivot pin 73 inserted through a respective throughbore 66 or 67 in the end 60 and through an aligned pair of throughbores 75 in the brackets 47, such that the spacers 57 pivot about axis "B" relative to the brackets 47, as shown in FIGS. 2 and 8.

The control means 9 include each of the throughbores 63 and 66 being spaced equidistantly from the lower edge 61, the throughbores 64 and 67 being spaced equidistantly from the lower edge 61, and the throughbores 55 and 75 being spaced equidistantly from corners 77 and 78, and from corners 80 and 81, respectively, as shown in FIG. 2.

The towing means 11 generally include harness having a first portion 83 and an opposing second portion 84 with pull cords 86 and 87, as illustrated in FIG. 1. The harness 83 is suitably attached to the brush assembly 13, such as by a pair of eyebolts 89 attached near opposite ends of the respective head 17 in the slot 50, as shown in FIGS. 6 and 7. Similarly, the harness 84 is attached to the brush assembly 15 by a pair of eyebolts 90 attached near opposite ends of the respective head 17, as shown in FIGS. 1 and 8.

In an application of the present invention, a user 92 inserts the pivot pins 56 and 73 through the corresponding bracket throughbores 55 and 75 and through a selected set of the throughbores in the spacers 57, such as the throughbores 63 and 66. The user 92 then places the apparatus 1 at a side 94 of freshly poured concrete flatwork 5. The user 92, then, either proceeds to a side 95 of the freshly poured concrete flatwork 5 opposite from the side 94, as shown in FIG. 1, or preferably is assisted by another user (not shown). It should be understood that the apparatus 1 can be operated by the user 92 working alone.

For two users working together, the idle user (not shown) generally allows this portion 83 of the harness to be limp, as suggested in FIG. 1, whereas the user 92 keeps his portion 84 of the harness 84 taut as required to displace the apparatus 1 across the flatwork, as indicated in FIG. 1. For the user 92 working alone, the portion 83 may be allowed to trail along behind the brush assemblies 13 and 15.

As the user 92 begins to pull on the cord 87, as indicated by the arrow designated by the numeral 96 in FIG. 1, the spacers 57 pivot about the pivot pins 56 and 73 until the lower edge 61 of the spacers 57 bear against the corners 77 and 80, as shown in FIG. 2, thereby forming a first sweeping configuration 96 whereat the heads 17 are oriented generally parallel to each other, with a substantially similar angular orientation 97 relative to horizontal, as shown in FIG. 2, as the apparatus 1 is pulled from the side 94 to the side 95.

Due to the angular orientation 97, the brush assemblies 13 and 15 are tilted toward the direction of travel or brooming, as shown in FIG. 1, such that the flatwork 5 is largely contacted by the sides of the bristles 21 as the bristles 21 slide generally tangentially over the flatwork 5. Thus, instead of substantially point-type contacts between the bristles and the flatwork as experienced with prior art type concrete finishing devices, the bristles 21 of the apparatus 1 establish substantially line-type or area-type contacts between the bristles 21 and the flatwork 5. Because of such tangential, line-type or area-type contacting, the flatwork 5 can be "broomed" with the apparatus 1 without waiting for the concrete material thereof to begin to harden.

In addition, the staggering of the bristle clusters 39 in combination with the tangential, line-type or area-type contacting eliminates, or at least substantially reduces, any tendency for the apparatus 1 to squeegee the "cream" from the freshly poured concrete, thereby avoiding exposure of the aggregate.

Upon completion of the sweep from the side 94 to the side 95, the user 92 simply picks up the apparatus 1, such as by one or more of the centrally located ones of the spacers 57, and places the apparatus 1 down on the flatwork 5 at the side 95 such that the next sweep of the apparatus 1 will slightly overlap the sweep that was just completed. Then, the user 92, or his helper, pulls on the cord 86.

As the user 92 begins to pull on the cord 86, the spacers 57 pivot about the pivot pins 56 and 73 until the lower edge 61 of the spacers 57 bear against the corners 78 and 81, as shown in FIG. 2, thereby forming a second sweeping configuration 98 whereat the heads 17 assume a similar angular orientation 99 relative to horizontal, as shown in FIG. 4, as the apparatus 1 is pulled from the side 95 to the side 94. The angular orientation 99 is equal in magnitude, but opposite in direction from, the angular orientation 97 in order to provide similar conditions for both the first and second sweeping configurations 96 and 98.

If the apparatus 1 is not providing the desired brooming results, either the blocks 19 may be slidingly endwise removed and replaced with ones of the blocks 19 having softer or stiffer bristles 21, and/or the angular orientation of the brush assemblies 13 and 15 may be increased or decreased by removing the pivot pins 56 and 73 and reinserting them through other corresponding throughbores in the spacers 57, such as the throughbores 64 and 67. For the selected example, the throughbores 64 and 67 are spaced farther from the lower edge 61 than are the throughbores 63 and 66. As a result, the brush assemblies 13 and 15 assume an angular orientation 99, which is closer to perpendicular to the flatwork than the angular orientation 97, for the sweeps in both directions as herein described.

For small areas where the apparatus 1 is too large and where a long handle can be used, one of the brush assemblies 13 or 15 can be removed from the apparatus 1 by removing the pins 56 or 73 from each of the spacers 57. For discussion purposes, it will be assumed that the brush assembly 15 is removed to broom finish those small areas, which can then be used with a connector 101 in an improved manner as hereinafter described.

The connector 101 has a body 103, which is generally cylindrically shaped, as shown in FIGS. 9 and 10. The body 103 has a generally vertically oriented slot 105 near a distal end 107 thereof, wherein the slot 105 is dimensioned to be slidably telescoped down over a centrally located one of the pairs of brackets 47, as shown in FIG. 10. The body 103 also has a transverse pair of aligned throughbores 109 adapted to be co-aligned with the throughbores 75 of the brackets 47 and to receive a pivot pin 111 therethrough such that the body 103 can pivot about a horizontally oriented axis "C" relative to the body 103, as shown in FIG. 10.

The connector 101 also includes a pair of bands 113 and 115, each with a nut and bolt 117 adapted to secure the bands 113 and 115 along the slot 105 as desired, as indicated by the arrows designated by the numeral 119 in FIG. 9. The user 92 adjusts the locations of the bands 113 and 115 to obtain the desired angular orientation, such as the angular orientation 97 previously described.

A proximal end 121 of the body 103 is tapped with "acme" threads 122 to receive a conventional screw-on type handle 123, as shown in FIG. 9. In addition, the diameter of the proximal end 121 has a "push-pin" release 125 and is dimensioned to receive a conventional "push-pin" type handle 127, as shown in FIG. 10. As a result, the connector 101 can be selectively and interchangeably used with either screw-on type handles 123 or push-pin type handles 127, whichever are available.

As the user 92 pushes the handle 123 or 127 and the brush assembly 15 away (to the right as shown in FIG. 9) to broom finish the underlying concrete flatwork (not shown), the brackets 47 bear against the band 113, thereby providing the desired angular orientation 97 of the brush assembly 15. Then, as the user 92 begins to pull on the handle 123 or 127 for the return sweep, the brackets 47 pivot about the pivot pin 111, as indicated by the arrow designated by the numeral 129 in FIG. 9, until the brackets 47 bear against the band 115, thereby providing the desired angular orientation of the brush assembly 15 for the return sweep.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for finishing freshly poured flatwork concrete, comprising:

(a) a first set of blocks, each having at least one row of bristles; each block of said first set of blocks having bristles of a different stiffness than those of the other blocks of said first set of blocks; each one of said first set of blocks having opposing, outwardly directed first ridges; said bristles being color coded as to stiffness;

(b) a second set of blocks, each having at least one row of bristles; each block of said second set of blocks having bristles of a different stiffness than those of the other blocks of said second set of blocks; each one of said second set of blocks having opposing, outwardly directed second ridges; said bristles being color coded as to stiffness;

(c) a first elongate head having a downwardly directed elongate first throat with a pair of opposing, inwardly directed first grooves; said pair of first grooves adapted to slidably receive said pair of first ridges lengthwise therethrough; said first head having a first stop and a second stop;

(d) a second elongate head having a downwardly directed elongate second throat with a pair of opposing, inwardly directed second grooves; said pair of second grooves adapted to slidably receive said pair of second ridges lengthwise therethrough; said second head having a third stop and a fourth stop;

(e) a plurality of pairs of first brackets attached to said first head;

(f) a plurality of pairs of second brackets attached to said second head;

(g) a plurality of spacers, each having a first end pivotally connected to a respective of said pairs of first brackets and a second end pivotally connected to a respective pair of said pairs of second brackets; said plurality of spacers adapted to bear against said first stop and said third stop to establish a first brooming configuration wherein said first and second heads assume a selected first angular orientation relative to the flatwork; said plurality of spacers adapted to bear against said third stop and said fourth stop to establish a second brooming configuration wherein said first and second heads assume a selected second angular orientation, equal to but opposite from that of said first angular orientation, relative to the flatwork; and (h) harness having a first portion thereof connected to said first head and a second portion thereof connected to said second head such that said apparatus is displaceable across the flatwork in said first brooming configuration by said first portion and said apparatus is displaceable across the flatwork is said second brooming configuration by said second portion.

2. An apparatus for finishing fleshly poured concrete flatwork, comprising:

(a) texturing means for texturing the surface of the flatwork; said texturing means including a pair of brush assemblies spaced parallel to each other such that said brush assemblies are displaced in tandem relative to the flatwork;

(b) mounting means for mounting said texturing means; said mounting means including a plurality of pairs of first brackets attached to a first one of said pair of brush assemblies, a plurality of pairs of second brackets attached to the other one of said pair of brush assemblies; and a plurality of spacers spaced parallel to each other, each of said plurality of spacers having a first end connected to a respective pair of said plurality of pairs of first brackets and the other end connected to a respective pair of said plurality of pairs of second brackets;

(c) control means for automatically controlling an angular orientation of said texturing means relative to the surface of the flatwork; and (d) displacing means for displacing said texturing means relative to the flatwork.

3. The apparatus according to claim 2, wherein said apparatus is adapted, in a single displacement across the surface of the flatwork, to texture a strip having a width of approximately eight feet.

4. The apparatus according to claim 2, wherein each of said brush assemblies includes blocks having bristles.

5. The apparatus according to claim 4, wherein said blocks are adapted to be replaceable.

6. The apparatus according to claim 4, wherein texturing of the surface of the flatwork is conducted substantially with the sides of the bristles.

7. The apparatus according to claim 4, wherein each of said blocks has bristles comprising a particular stiffness, which is different from the stiffness of at least another one of said blocks.

8. The apparatus according to claim 7, wherein the stiffness of said bristles is color coded.

9. The apparatus according to claim 2, wherein said control means includes means for establishing a selected angular orientation of said first and second brush assemblies relative to the underlying flatwork in the direction of travel as the apparatus is displaced across the flatwork in a first direction and to automatically re-establish a substantially similar angular orientation of said first and second brush assemblies relative to the underlying flatwork in the direction of travel as the apparatus is displaced across the flatwork in a second direction which is opposite to that of said first direction.

10. The apparatus according to claim 9, wherein said control means includes:

(a) said plurality of pairs of first brackets being attached to a first upper surface of a first head of said first one of said pair of brush assemblies, said first head having a first stop and a second stop; and said plurality of pairs of second brackets being attached to a second upper surface of a second head of said other one of said pair of brush assemblies, said second head having a third stop and a fourth stop;

(b) each of said plurality of spacers having a bottom edge, a first spacer throughbore in said first end and a second spacer throughbore; said first spacer throughbore in said second end such that said first and second spacer throughbores are spaced equidistantly from said bottom edge;

(b) each of said plurality of pairs of first brackets having a pair of first bracket throughbores co-linearly alignable with said first spacer throughbore, and each of said plurality of pairs of second brackets having a pair of second bracket throughbores co-linearly alignable with said second spacer throughbore such that said first bracket throughbores and said second bracket throughbores are spaced equidistantly from said first stop and said second stop, and from said third stop and said fourth stop, respectively;

(d) a plurality of first pivot pins, each contained within a respective one of said first spacer throughbores and a respective pair of said first bracket throughbores such that said first ends are pivotally connected to said plurality of first pairs of brackets; and (e) a plurality of second pivot pins, each contained within a respective one of said second spacer throughbores and a respective pair of said second bracket throughbores such that said second ends are pivotally connected to said plurality of second pairs of brackets;

(f) wherein said first angular orientation is established by said bottom edges bearing against said first stop and said third stop, and said second angular orientation is established by said bottom edges bearing against said second stop and said fourth stop.

11. The apparatus according to claim 10, wherein each of said spacers has more than one of said first spacer throughbores and, for each of said first spacer throughbores, said spacers have a corresponding second spacer throughbore, wherein said first spacer throughbores and their corresponding second spacer throughbores are spaced equidistantly from respective said lower edges.

12. The apparatus according to claim 18, including:

(a) said pair of brush assemblies being releasable from said plurality of spacers;

(b) a connector adapted to be pivotally connected to a centrally located one of said plurality of pairs of first brackets attached to said pair of brush assemblies; and (c) a handle adapted to be connected to said connector.

13. An apparatus for finishing fleshly poured concrete flatwork, comprising:

(a) texturing means for texturing the surface of the flatwork; said texturing means including a pair of brush assemblies spaced parallel to each other such that said brush assemblies are displaced in tandem relative to the flatwork;

(b) mounting means for mounting said texturing means; said mounting means including a plurality of pairs of first brackets attached to a first one of said pair of brush assemblies, a plurality of pairs of second brackets attached to the other one of said pair of brush assemblies; and a plurality of spacers spaced parallel to each other, each of said plurality of spacers having a first end connected to a respective pair of said plurality of pairs of first brackets and the other end connected to a respective pair of said plurality of pairs of second brackets;

(c) control means for automatically controlling an angular orientation of said texturing means relative to the surface of the flatwork;

(d) displacing means for displacing said texturing means relative to the flatwork;

(e) a connector adapted to be pivotally connected to a centrally located one of said plurality of pairs of first brackets; said connector including a pair of adjustable stops such that said at least one of said pair of brush assemblies assumes a first angular orientation for brooming in a first direction as determined by the spacing of one of said pair of stops and said at least one of said pair of brush assemblies assumes a second angular orientation for brooming in a second direction, opposite to that of said first direction, as determined by the spacing of the other one of said pair of stops; and (f) a handle adapted to be connected to said connector; and (g) wherein said pair of brush assemblies are releasable from said plurality of spacers.

14. The apparatus according to claim 13, wherein said apparatus automatically changes to and from said first angular orientation and said second angular orientation as a user operably changes to and from a push-type action and a pull-type action.

15. The apparatus according to claim 13, wherein said connector is connectable to said handle regardless of whether said handle has a screw-on configuration or a push-pin type configuration.

* * * * *

UNITED STATES PATENT AND TRADEMARK OFFICE

CERTIFICATE OF CORRECTION

PATENT NO. : 5,549,413

DATED : August 27, 1996

INVENTOR(S) : Gary A. Bolden

It is certified that error appears in the above-indentified patent and that said Letters Patent is hereby corrected as shown below:

In Claim 2, Column 9, Line 38: delete "fleshly" and insert --freshly-- therefor.

In Claim 12, Column 11, Line 5: delete "18" and insert --2-- therefor.

In Claim 13, Column 11, Line 12: delete "fleshly" and insert --freshly-- therefor.

Signed and Sealed this

Twenty-sixth Day of November 1996

*Attest:*

Bruce Lehman

BRUCE LEHMAN

*Attesting Officer*

*Commissioner of Patents and Trademarks*